United States Patent [19]

Oka

[11] Patent Number: 4,640,883

[45] Date of Patent: Feb. 3, 1987

[54] METHOD OF FORMING COMPOSITE OR DICHROMATIC IMAGES

[75] Inventor: Tateki Oka, Toyohashi, Japan

[73] Assignee: Minolta Camera Kabushiki Kaisha, Osaka, Japan

[21] Appl. No.: 674,281

[22] Filed: Nov. 21, 1984

[30] Foreign Application Priority Data

Nov. 30, 1983 [JP] Japan ..... 58-227472

[51] Int. Cl.[4] ..... G03G 13/08

[52] U.S. Cl. ..... 430/122; 430/106.6; 430/120

[58] Field of Search ..... 430/122, 106.6, 120, 430/54

[56] References Cited

U.S. PATENT DOCUMENTS 4,346,982 8/1982 Nakajima et al. ..... 430/54
4,349,270 9/1982 Wada et al. ..... 355/15
4,525,447 6/1985 Tanaka et al. ..... 430/122

FOREIGN PATENT DOCUMENTS 57-8553 1/1982 Japan .

*Primary Examiner*—John L. Goodrow
*Attorney, Agent, or Firm*—Wenderoth, Lind & Ponack

[57] ABSTRACT

The invention disclosed relates to a method of forming composite images or dichromatic copy images free from fog. The method includes the first step of forming on an electrostatic latent image bearing surface electrostatic latent images having at least three different potential levels, the first and second latent images being represented respectively by a first potential and a second potential relative to a common background area potential; the second step of developing the first and second images by first magnetic brush developing means using two kinds of toners at least one of which is magnetic and which are chargeable to polarities opposite to each other, with application to a developing electrode of a bias voltage capable of depositing the magnetic toner on the background potential area, to selectively deposit the two toners on the first and second latent images and to deposit the magnetic toner on the background potential area, while collecting the deposited magnetic toner at least from the background potential area by second magnetic brush developing means; and the third step of transferring the developed images.

7 Claims, 17 Drawing Figures

METHOD OF FORMING COMPOSITE OR DICHROMATIC IMAGES

BACKGROUND OF THE INVENTION

1. Field of the Invention

The present invention relates to a method of forming satisfactory composite images or dichromatic copy images free from fog.

2. Description of the Prior Art

To comply with diversified modes of processing information in recent years, copying machines have been devcloped for forming composite copy images by forming on an electrostatic latent image bearing surface a first latent image and a second latent image successively or simultaneously, the second latent image being opposite in polarity to the first latent image or having the same polarity as the first image but being different therefrom in potential, developing the first and second latent images thus formed as a composite image to obtain a toner image, and transferring the toner image to the surface of a transfer material.

Published Unexamined Japanese patent application No. SHO 57-8553 discloses a copying machine of the type described above which is adapted to form a composite electrostatic latent image as shown in FIG. 1*a*. More specifically the photosensitive member is charged to a predetermined surface potential Vs and then exposed to a positive image to form a first electrostatic latent image. The amount of exposure at this time is such that the resulting background area has an intermediate potential VL which is approximately a half of Vs. The area of the intermediate potential VL is then exposed to a negative image to form a second electrostatic latent image represented by a potential VLL.

Sometimes, however, there arises a need to develop the first and second latent images with toners of different colors for the purpose of edition, discrimination or the like. In this case, it is usually necessary to use two developing units and therefore to use a copying machine of correspondingly increased size. This drawback can be overcome by using a single developing unit for developing the first and second latent images with toners of different colors.

In this connection, the present applicant already proposed in U.S. patent application Ser. No. 535,933 filed on Oct. 27, 1983 to develop such composite latent images in two colors with a three-component developer comprising a magnetic carrier, a magnetic toner and a nonmagnetic toner. According to the proposal, the composite electrostatic latent image shown in FIG. 1*a* is developed by the magnetic brush process using a positively charged black toner as the magnetic toner and a negatively charged red toner as the nonmagnetic toner. The process is practiced with application of a bias voltage set to a level somewhat higher than the intermediate potential VL as shown in FIG. 1*b*, whereby the red nonmagnetic toner is deposited on the first latent image and the black toner on the second latent image. Moreover the nonmagnetic toner is deposited on the edge portion of the second latent image of the negative due to an edge effect because the nonmagnetic toner is not restrained magnetically unlike the magnetic toner and is therefore prone to deposition. Nevertheless, the transferred image is susceptible to fogging. Further when the developer containing a magnetic toner and a nonmagnetic toner is used as above, the magnetic toner is generally less amenable to development owing to magnetic restraint, with the result that a difference occurs in the image density between the two toners as seen in FIG. 1*b*.

These drawbacks are experienced also when dichromatic originals are copied in two colors. Thus, it has been difficult to obtain satisfactory copy images.

SUMMARY OF THE INVENTION

The main object of the present invention is to provide a method of forming fog-free satisfactory copy images while not permitting deposition of toner due to the edge effect.

Another object of the invention is to provide a method of forming fog-free dichromatic or composite copy images at a high density.

Another object of the invention is to provide a method of forming sharp dichromatic or composite copy images by a simple arrangement and under easily settable conditions.

These and other objects of the present invention can be fulfilled by an image forming method which consists essentially of the first step of forming on an electrostatic latent image bearing surface electrostatic latent images having at least three different potential levels and including a positive first electrostatic latent image and a negative second electrostatic latent image, the first and second latent images being represented respectively by a first potential and a second potential relative to a common background area potential; the second step of developing the first and second images by first magnetic brush developing means using two kinds of toners at least one of which is magnetic and which are chargeable to polarities oppposite to each other, with application to a developing electrode of a bias voltage capable of depositing the magnetic toner on the background potential area, to selectively deposit the two toners on the first and second latent images and to deposit the magnetic toner on the background potential area, while collecting the deposited magnetic toner at least from the background potential area by second magnetic brush developing means; and the third step of transferring the developed images to a transfer material.

DETAILED DESCRIPTION OF THE INVENTION

Figure 2:
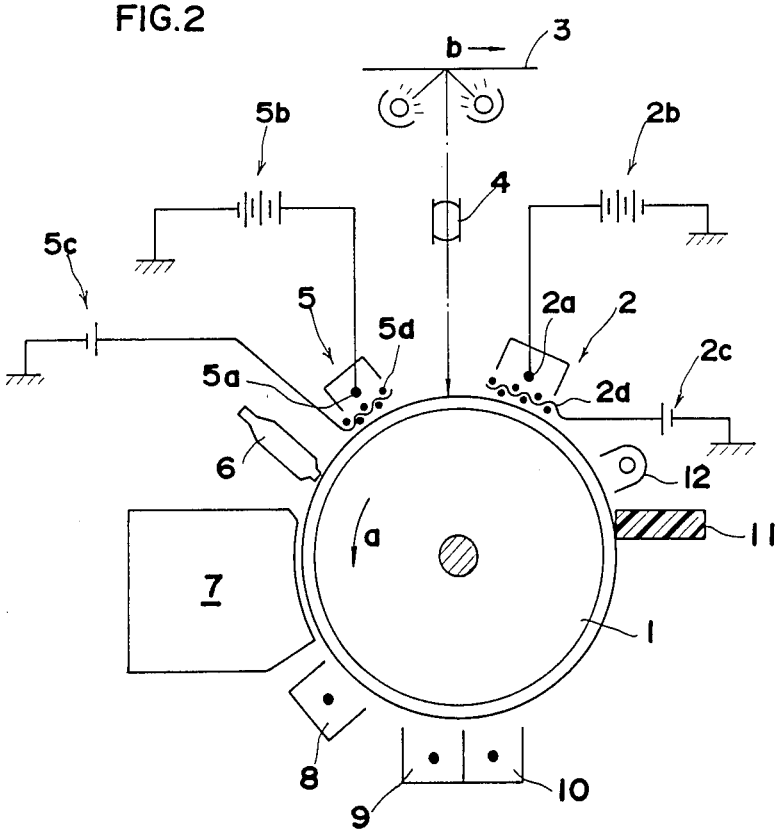
FIG. 2 is a diagram in section showing the construction of a copying machine for practicing the image forming process of the invention, the machine being especially suited for forming composite images.

FIG. 2 is a diagram showing an example of copying machine useful for practicing the image forming method of the present invention and suitable for forming composite images. An electrophotographic photosensitive drum 1 drivingly rotatable in the direction of arrow a shown is first uniformly charged to a specified polarity by a first scorotron charger 2 and is subsequently continuously exposed to an optical image corresponding to a positive original 3, i.e. a positive image, by an optical system 4. Consequently a first latent image is formed on the surface of the drum 1. During the exposure, the original 3 is moved in the direction of arrow b in synchronism with the rotation of the drum 1.

The charger 2 has a corona electrode 2*a* connected to a d.c. high voltage source 2*b*, and a grid electrode 2*d* connected to a d.c. bias voltage source 2*c* and interposed between the corona electrode 2*a* and the drum 1. The charger 2 uniformly charges the surface of the drum 1 to a potential approximately equal to the bias voltage applied to the grid electrode 2*d*. The charger for uniformly charging the drum surface is not limited to the scorotron type as above but may be of the corotron type.

Like the charger 2, a second scorotron charger 5 has a corona electrode 5*a* connected to a d.c. high voltage source 5*b*, and a grid electrode 5*d* connected to a d.c. bias voltage source 5*c* and interposed between the corona electrode 5*a* and the drum 1, whereby the potential of the background area of the first latent image formed as above is made approximately equal to the bias potential applied to the grid electrode 2*d*. The bias voltage source 5*c* may be replaced by a constant-voltage diode, discharge tube, ZnR or like constant-voltage driven element. The charging by the second scorotron charger 5 can be omitted if the background area potential is attenuated to a stable potential by the exposure of the drum surface to the positive image of the original 3.

The surface of the drum 1 having the positive first latent image formed thereon is continuously exposed to a negative image by a light-emitting diode 6 to form a second latent image on the drum surface. The negative image is produced in accordance with electric signals supplied from an unillustrated image processing apparatus. The light-emitting diode 6 can be replaced by suitable means, such as a laser scanner, OFT or liquid crystal array, for forming the second latent image.

A magnetic brush developing unit 7, which will be described in detail later, is adapted to develop the first and second latent images with a magnetic developer by depositing two kinds of toners selectively on these images. When required, the two toners may be different in color.

Prior to image transfer, the toners deposited on the surface of the drum 1 are adjusted to the same polarity by a precharging corona charger 8. A transfer corona charger 9 is adapted to transfer the developed toner image to the surface of copy paper. The charger 9 has attached thereto a separating corona charger 10 by which the copy paper having the toner image transferred to its suface is separated from the drum surface. The developer remaining on the surface of the drum 1 is removed therefrom by a cleaner blade 11. The charges remaining on the drum surface are erased by an eraser lamp 12.

Figure 3:
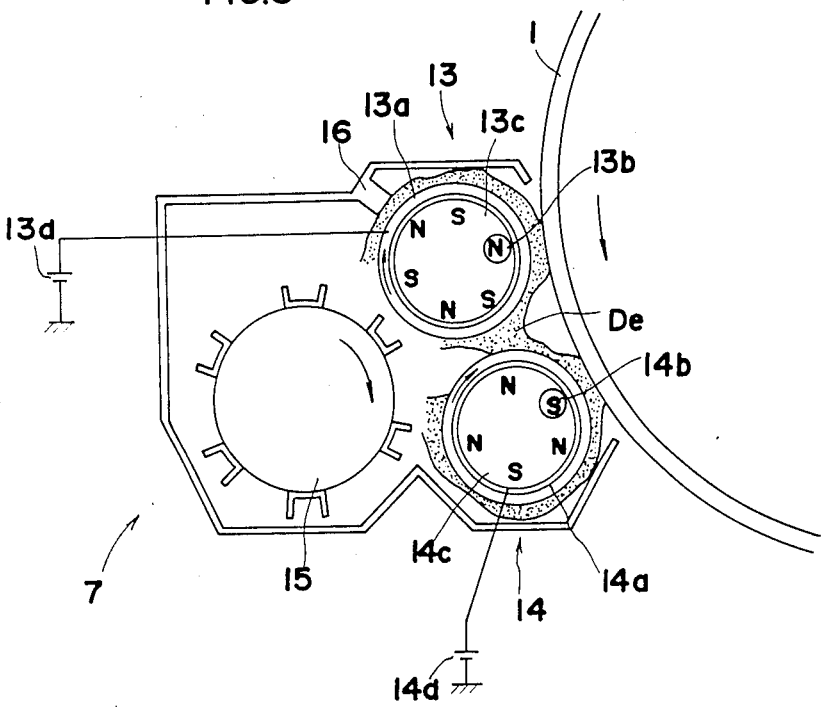
FIGS. 3 and 4 are diagrams showing magnetic brush developing units for use in the invention.

FIG. 3 shows the magnetic brush developing unit 7 in greater detail. The unit 7 comprises first and second developing rollers 13, 14 opposed to the photosensitive drum 1 and a bucket roller 15 for transporting and agitating the magnetic developer. Indicated at 16 is a bristle height regulating plate formed on the casing of the unit 7 and opposed to the first developing roller 13. The first developing roller 13 comprises a first developing sleeve 13*a* rotatable clockwise and a first magnet roller 13*c* fixedly positioned within the sleeve 13*a*. The first magnet roller 13*c* has a plurality of magnetic poles including a main pole 13*b* and is connected to a first developing bias voltage source 13*d* for applying a predetermined bias voltage VB1. The second developing roller 14, which has substantially the same construction as the first developing roller 13, comprises a clockwise rotatable second developing sleeve 14*a* and a magnet roller 14*c* having a plurality of magnetic poles which include a main pole 14*b*. A second developing bias voltage source 14*d* is connected to the magnet roller 14*c*. The main pole 14*b* of the second magnet roller 14*c* opposed to the drum 1 has a greater magnetic force than the main pole 13*b* of the first magnet roller 13*c*.

With the magnetic brush developing unit 7 of the foregoing construction, the magnetic developer De is supplied to the surface of the first sleeve 13*a* of the first developing roller 13 while being agitated by the bucket roller 15. While the magnetic developer De is thus transported by the rotation of the sleeve 13*a*, the height of bristles of the brush is regulated by the plate 16, and the developer develops the composite electrostatic latent image when brought to the position opposed to the drum 1. The magnetic developer De is further transported to the surface of the sleeve 14*a* of the second developing roller 14, develops the latent image on the drum 1 again and is agitated by the bucket roller 15 again when released from the sleeve surface.

Figure 4:
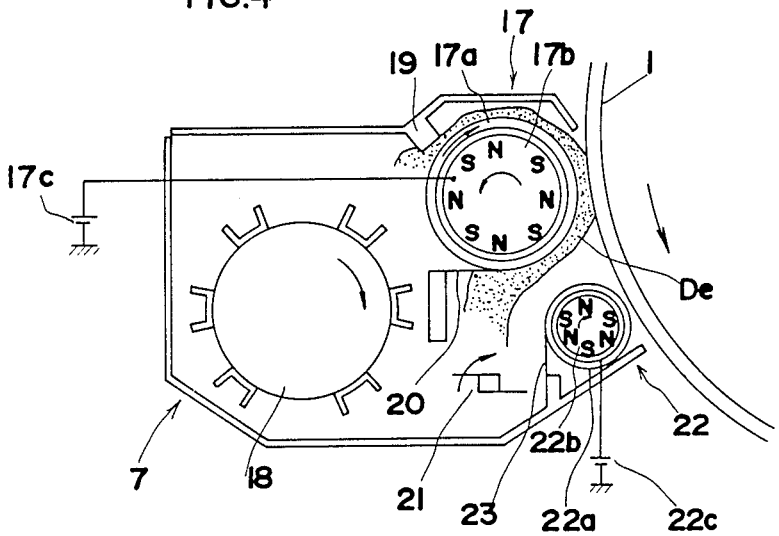

The magnetic brush developing unit 7 is not limited to the construction shown in FIG. 3 but can be of the construction shown in FIG. 4. With reference to FIG. 4, a first developing roller 17 opposed to the surface of the drum 1 as spaced therefrom by a definite gap comprises a first developing sleeve 17*a* which is rotatable clockwise and a first magnet roller 17*b* provided within the sleeve 17*a*, rotatable counterclockwise and connected to a first developing bias voltage source 17*c*. Indicated at 18 is a bucket roller for agitating and transporting a magnetic developer De. The developer De is supplied to the surface of the sleeve 17*a* of the first developing roller 17, has the height of its bristles regulated by a bristle height regulating plate 19, develops a composite electrostatic latent image on the photosensitive drum 1, is subsequently scraped off the surface of the first developing sleeve 17*a* by a scraper 20 and is then returned toward the bucket roller 18 by a conveying blade device 21. A second developing roller 22 is disposed below the first developing roller 17 and spaced apart from the drum 1 by a definite gap in opposed relation thereto. The gap is smaller than the corresponding gap for the first developing roller 17. The second developing roller 22 comprises a fixed second developing sleeve 22*a* connected to a second developing bias voltage source 22*c* and a second magnet roller 22*b* provided within the sleeve 22*a* and rotatable clockwise as magnetically induced by the rotation of the first magnet roller 17*b*. As will be described later, the roller 22 collects the magnetic toner deposited on the background area of the developed composite latent image.

Indicated at 23 is a scraper for scraping the magnetic toner off the sleeve 22*a*.

The magnetic developer to be used in this invention will now be described. According to the invention, any magnetic developer is usable as long as the developer consists essentially of a magnetic toner and a nonmagnetic toner which are chargeable to polarities opposite to each other. Exemplary of such a magnetic toner is one which is at least $10^{12}$ ohm-cm in resistivity and 5 to 20 μm in particle size and which comprises a resin and a magnetic fine powder. The magnetic toner can be prepared by dispersing the fine magnetic powder in the resin, i.e. by mixing the two materials together in a molten state, pulverizing the mixture after cooling and separating a fraction of desired particle size by screening. Examples of useful resins are polyethylene, polyacrylic acid ester, polymethyl methacrylate, polystyrene, styrene-acrylic polymer, epoxy resin, cumarone resin, maleic resin, phenolic resin, fluoric acid resin, etc. Examples of useful magnetic fine powders are those of $Fe_2O_3$, $Fe_3O_4$, ferrite, magnetite and the like which are 0.1 to 5 μm in mean particle size.

The nonmagnetic toner to be used is a known one having insulating properties, 5 to 20 μm in particle size and triboelectrically chargeable to a polarity opposite to that of the magnetic toner. The developer may be a two-component one comprising these magnetic and nonmagnetic toners, or a three-component developer further containing a magnetic carrier in addition to these toners.

As an example of a three-component developer, it is possible to use the one proposed by the present applicant in the aforementioned application Ser. No. 545,933. This developer is a mixture of at least three components, i.e. a magnetic carrier, a nonmagnetic toner triboelectrically chargeable to a definite polarity by contact with the magnetic carrier, and a magnetic toner triboelectrically chargeable to a polarity opposite to the polarity of the nonmagnetic toner by contact therewith but substantially not triboelectrically chargeable by contact with the magnetic carrier. The nonmagnetic toner and the magnetic toner usable are similar to those mentioned above. The magnetic carrier is 25 to 50 μm in particle size and can be prepared from the same composition as used for the above-mentioned magnetic toner.

The magnetic toner and the nonmagnetic toner may have the same color, or different colors for discrimination.

The image forming process of the present invention is practiced in the following manner.

Figure 5A:
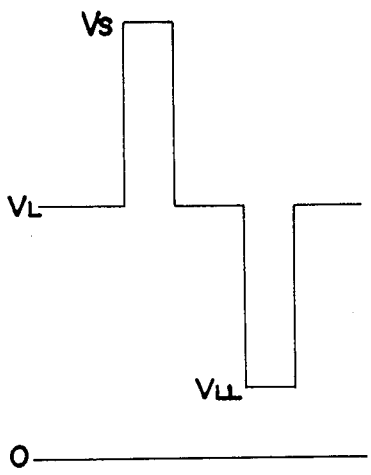
FIGS. 5*a* to 5*d* are diagrams showing the steps of forming a composite image according to the invention.

The step of forming electrostatic latent images will be described first. The photosensitive drum 1 is charged to a predetermined surface potential Vs by the first scorotron charger 2 and subsequently exposed to the image of the positive original 3 by the optical system 4 to form a first electrostatic latent image. Next, the drum 1 is charged by the second scorotron charger 5. At this time, the voltage to be applied by the d.c. bias voltage source 5*c* is set to a level higher than the potential of the background area attenuated by the exposure to the positive original image but lower than Vs, preferably approximately a half of Vs, to charge the background area to a corrected stable intermediate potential VL. However, the charging by the second scorotron charger can be omitted as already stated if the exposure to the positive original image has already reduced the background area potential to a stable intermediate potential. Subsequently the area of the intermediate potential VL is exposed to a negative image by the light-emitting diode 6 to form a second electrostatic latent image represented by a potential VLL which is lower than VL. Consequently a composite electrostatic latent image is formed as shown in FIG. 5*a*. The potentials Vs, VL and VLL are all of the same polarity.

The composite latent image thus formed is then developed by the magnetic brush developing unit 7. Employed for the developing step to be described below in detail are the developing unit shown in FIG. 3 and a magnetic developer which contains at least a negatively charged nonmagnetic toner and a positively charged magnetic toner. The latent image potentials are assumed to be of positive polarity.

Figure 1A:
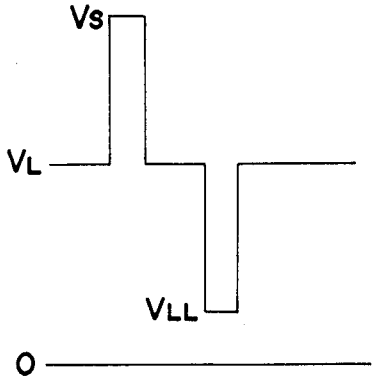
FIG.1a Prior Art
FIGS. 1*a* and 1*b* are diagrams showing the potential pattern of a composite electrostatic latent image obtained by a conventional copying machine and a developing process.
Figure 1B:
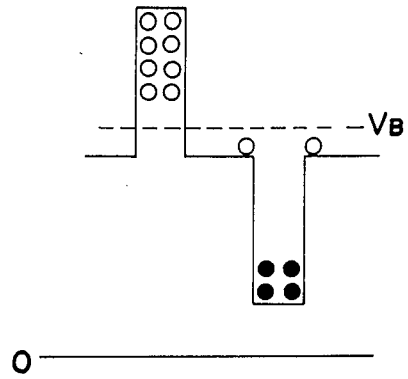
FIG.1b Prior Art

The magnetic developer is supplied to the surface of the first sleeve 13*a* of the first developing roller 13 to develop the composite latent image at the developing station. For development, the nonmagnetic toner is deposited on the first latent image represented by the potential Vs by normal development, and the magnetic toner is deposited on the second latent image represented by VLL by reversal development. In this case, a developing bias voltage which is set to a value somewhat higher than the intermediate potential VL is conventionally applied for development, but the problem then arises that the nonmagnetic toner adheres to the edge portion of the second latent image owing to an edge effect. The reason is that the edge effect intensifies the electric field of the edge portion, with the result that with reference to FIG. 1*b*, the intensity of the electric field exceeds the developing bias voltage VB to permit deposition of the nonmagnetic toner to result in fog.

Figure 5B:
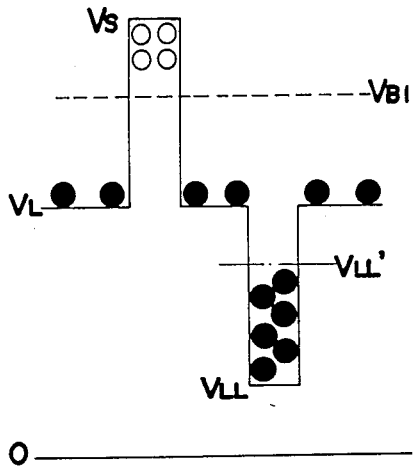

According to the present invention, however, the developing bias voltage VB1 to be applied to the first developing roller 13 by the first developing bias voltage source 13*d* is set to a level sufficiently higher than the intermediate potential VL to avoid foregoing, i.e. to a value at least higher than the electric field intensity of the edge portion of the second latent image. In connection with this, the nonmagnetic toner used is adapted to have a deposition threshold voltage of 0 V to not higher than tens of volts relative to the developing bias voltage VB1, while the magnetic toner is adapted to have a deposition threshold voltage smaller than the difference between the bias voltage VB1 and the intermediate potential VL, i.e. VB1—VL, relative to the bias voltage VB1, preferably about 30 V to about 150 V in value. Accordingly the nonmagnetic toner is deposited by the first developing roller 13 on the positive first latent image above the bias voltage VB1 in a range which exceeds the deposition threshold potential of the nonmagnetic toner beyond VB1, while the magnetic toner is deposited on the negative second latent image. However, since the deposition threshold potential of the magnetic toner is smaller than the difference between the bias voltage VB1 and the intermediate potential VL as already stated, the magnetic toner is deposited also on the intermediate potential area, i.e. background area, almost uniformly as seen in FIG. 5*b*. As will be apparent also from this diagram, the magnetic toner, which is deposited to a lesser extent conventionally, is deposited on the latent image area to a high density. Because the bias voltage VB1 is set to a high level, the density of the deposited nonmagnetic toner is somewhat low, but the low density is remedied subsequently by the development with the second developing roller 14.

Figure 5C:
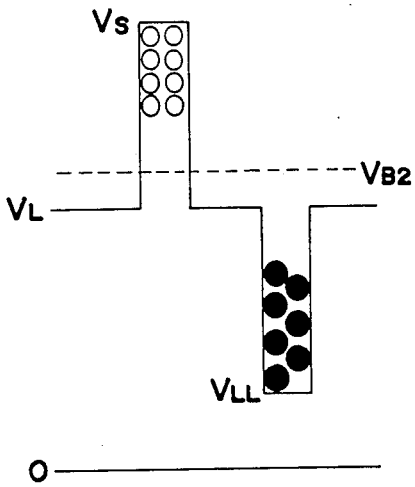

FIG. 5*c* shows the composite image as developed by the second developing roller 14. As is apparent, the magnetic toner deposited on the area of the intermediate potential VL has been removed by collection, and the nonmagnetic toner, as well as the magnetic toner, is deposited to an increased density. In particular, the developing bias voltage VB2 to be applied by the second developing bias voltage source 14*d* is set to a level somewhat higher than the intermediate potential, such that the difference between the voltage VB2 and the potential VL, i.e. VB2−VL, is smaller than the deposition threshold voltage of the magnetic toner. Accordingly the nonmagnetic toner is further deposited on the first latent image area to result in an increase in density at least corresponding to the potential difference VB1−VB2 when compared with the state shown in FIG. 5*b*. Further the amount of magnetic toner deposited on the second latent image also slightly increases. Because the difference between VB2 and VL is smaller than the threshold voltage of the magnetic toner as already stated when the second developing roller 14 operates for development, the magnetic attraction of the second magnet roller 14*c* of the second developing roller 14 is greater than the electrostatic adhesion of the magnetic toner to the drum 1, with the result that the magnetic toner deposited on the area of intermediate potential VL by the first developing roller 13 is collected by the second roller 14. No magnetic toner therefore remains on the intermediate potential area. Since the main pole 14*b* of the second magnet roller 14*c* has a greater magnetic force than the main pole 13*b* of the first magnet roller 13*c* as already described, the magnetic toner can be collected almost completely and efficiently. With the no magnetic toner remaining on the intermediate potential area, it appears likely that the nonmagnetic toner will adhere to the edge portion of the negative second latent image owing to an edge effect. Nevertheless, because the magnetic toner is deposited on the second latent image area by the first developing roller 13 as shown in FIG. 5*b*, the substantial potential of the second latent image increases to VLL' before the development by the second roller 14, so that the edge effect diminishes without entailing deposition of the nonmagnetic toner on the edge portion.

Figure 5D:
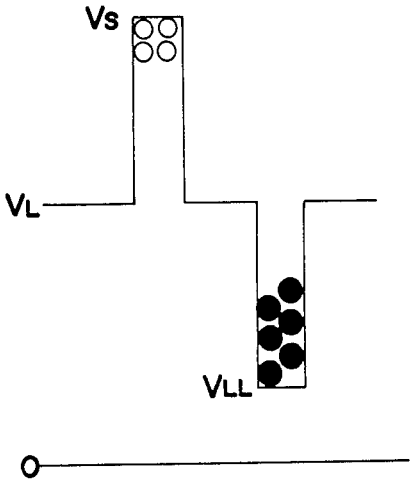

The developing unit of FIG. 4 also functions similarly except that no developer is supplied to the second developing roller 22 unlike the unit of FIG. 3. The difference between the bias voltage VB2 applied to the roller 22 from the second voltage source 22*c* and the intermediate potential VL is smaller than the deposition threshold voltage of the mangetic toner, so that the second roller 22 collects the magnetic toner deposited on the intermediate potential area, whereby the image shown in FIG. 5*d* is eventually obtained. The sleeve 22*a* of the second roller 22 is spaced from the drum 1 by a smaller gap than the sleeve 17*a* of the first roller. This assures almost complete collection of the magnetic toner.

Another case which is the converse of the above will be described wherein a negatively charged magnetic toner and a positively charged nonmagnetic toner are used. In this case, the magnetic toner is deposited on the first latent image, and the nonmagnetic toner on the second latent image, selectively. To prevent deposition of the nonmagnetic toner on the edge portion of the first latent image at this time, the bias voltage VB1 is set to a value lower than the intermediate potential VL, unaffected by the intensity of electric field of the edge portion and greater than the deposition threshold voltage of the magnetic toner relative to the intermediate potential VL. This causes the magnetic toner to adhere to the intermediate potential area almost uniformly but does not permit deposition of the nonmagnetic toner on the edge portion of the first latent image. For the development by the second developing roller 14 or 22, the bias voltage VB2 is set to a value slightly lower than the intermediate potential VL. According to the invention, however, the bias voltage VB1 for the first developing roller 13 or 17 is set to a value which is greater than the deposition threshold voltage of the magnetic toner with respect to the intermediate potential VL and which is not influenced by the electric field intensity of the first or second latent image edge portion. This assures fog-free copy images.

The composite electrostatic latent image developed by the magnetic brush developing unit 7 in this way is subsequently charged to positive or negative polarity by the precharging corona charger. The deposited magnetic and nonmagnetic toners are therefore adjusted to the same polarity. The toner image is transferred by the transfer corona charger 9 to copy paper, which is then separated from the drum 1 by the corona charger 10. The toners remaining on the drum surface are removed by the cleaning blade 11, while the remaining charges are erased by the lamp 12. The apparatus is now ready for the next copying cycle.

The present invention is not limited to the formation of such composite images as described above but can be practiced also for forming dichromatic copy images from dichromatic originals.

Figure 6:
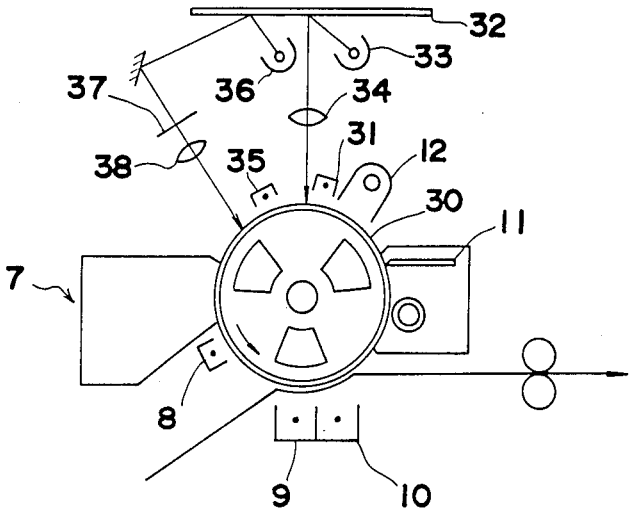
FIG. 6 is a diagram schematically showing the construction of a copying machine for practicing the image forming process of the invention, the machine being suited for forming dichromatic copy images.

FIG. 6 shows a copying machine for forming a dichromatic image from a dichromatic original by the method of the present invention. The same parts as those shown in FIG. 2 will be referred to by the same corresponding numerals individually and will not be described.

With reference to FIG. 6, a photosensitive drum 30 which is sensitive to both positive and negative polarities and rotatable counterclockwise is first uniformly charged to a first polarity by a first corona charger 31. Subsequently a dichromatic original placed on a reciprocatingly movable carriage 32 is illuminated with an exposure lamp 33, and the image of the original is continuously projected onto the drum 30 through a lens 34, whereby a primary electrostatic latent image is formed. This latent image is then charged by a second corona charger 35 of second polarity. The same original is thereafter exposed to light by an exposure lamp 36, and the image of the original is projected on the drum through a cutoff filter 37 and a lens 38 to form a secondary electrostatic latent image. A magnetic brush developing unit 7 has the same construction as the one shown in FIGS. 3 or 4.

Figure 7A:
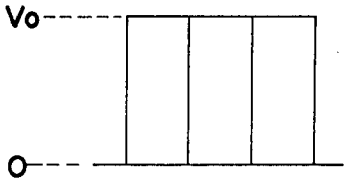
FIGS. 7*a* to 7*f* are diagrams showing the steps of forming a dichromatic copy image.
Figure 7B:
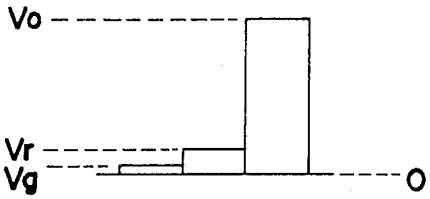
Figure 7C:
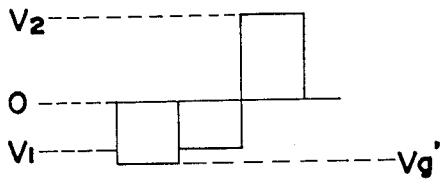
Figure 7D:
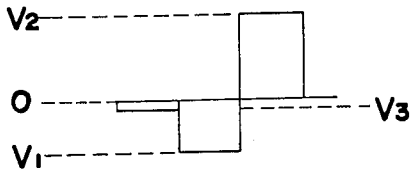

With the copying machine of the foregoing construction, the drum 30 in rotation is first uniformly charged by the first corona charger 31 to a surface potential Vo of positive polarity as shown in FIG. 7*a*. Next, the drum 30 is exposed to the optical image of a dichromatic original to form a primary electrostatic latent image thereon as seen in FIG. 7*b*. When the original includes a red image and a black image, the exposure attenuates the potential Vo to VR at the portion corresponding to the red image area and to Vg, approximately to 0, at the nonimage area (blank area), but the potential remains almost Vo at the black image area. The primary latent image having the potential pattern of Vo, Vr and Vg is charged by the second corona charger 35 to negative polarity to form the pattern of FIG. 7*c*. Thus, the lowest nonimage area potential Vg is inverted to Vg' of the negative polarity and the red image area potential Vr is also inverted to V1 of negative polarity by the negative charging, with the black image area potential Vo lowered to V2 and retaining the positive polarity. In this state, the drum 30 is exposed again to the optical image of the same original through the red cutoff filter 37 at this time to thereby form a secondary electrostatic latent image of the potential pattern shown in FIG. 7*d*. This exposure attenuates the nonimage area potential Vg' V3 approximate to 0, while permitting the red and black image area potentials V1 and V2 to remain unchanged.

Figure 7E:
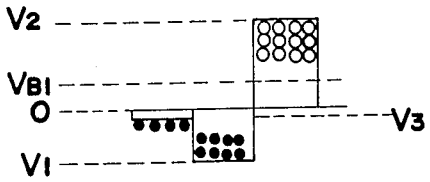

The secondary latent image is subsequently developed by the unit 7. As in one of the foregoing cases, employed for the developing step to be described below are the developing unit of FIG. 3 and a magnetic developer which comprises a negatively charged nonmagnetic toner and a positively charged magnetic toner. By means of the first developing roller 13, the nonmagnetic toner is deposited through normal development on the black image area represented by V2, and the magnetic toner is deposited similarly through normal development on the red image area represented by V1. The developing bias voltage VB1 to be applied to the first developing roller 13 by the bias voltage source 13*d* at this time is set to a value exceeding the deposition threshold voltage of the magnetic toner and the electric field intensity at the edge portion of the red image area with respect to the nonimage area potential V3. The result is illustrated in FIG. 7*e*, which shows that the magnetic toner is uniformly deposited also on the nonimage area V3. Depending on the polarity of V3 and on the potential relationship between V1 and V2, it is likely that the bias voltage VB1 will be of negative polarity or 0 V (apparent grounding).

Figure 7F:
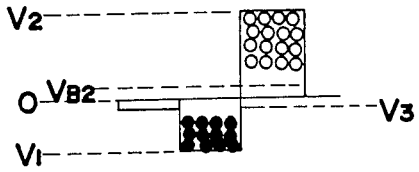

FIG. 7*f* shows the image as developed by the second developing roller 14. The developing bias voltage VB2 is set to such a level that the difference VB2−V3 is smaller than the deposition threshold voltage of the magnetic toner. On the other hand, the magnetic toner on the area V3 is collected.

Desired processes, such as those disclosed in U.S. Pat. No. 4,335,194, Published Unexamined Japanese patent application No. SHO 54-112634, etc., are latent images from dichromatic originals. In connection with the background potential, in this case, the first-color and second-color latent images are generally in opposite relation to each other in polarity in the neighborhood of 0 V, and the bias voltage VB1 is so set as to exceed the threshold voltage of the magnetic toner and the electric field intensity at the edge portion with respect to the background potential.

Experimental examples are given below.

EXPERIMENTAL EXAMPLE 1

The copying machine shown in FIG. 2 was used. The surface of the photosensitive drum 1 was uniformly charged to +600 V by the charger 2 and then exposed to a positive image through the optical system 4 to form a first latent image having an image area potential Vs of +600 V with reference to FIG. 5*a*. The nonimage area on the drum 1 was thereafter charged by the charger 5 so that the nonimage area potential, i.e. the intermediate potential VL, increased to +350 V, and the drum was exposed to a negative image through the light-emitting diode 6 to form a second latent image having an image area potential VLL of +100 V.

The magnetic brush developing unit 7 used had the construction shown in FIG. 3. The first sleeve 13*a* of the first developing roller 13 had a diameter of 31 mm and was rotated at 250 r.p.m. The sleeve 13*a* opposed to the drum 1 was spaced therefrom by a 0.8-mm gap and also from the bristle height regulating plate 16 by a distance of 0.8 mm. The main pole 13*b* of the first magnet roller 13*c* was 750 G, and the other poles thereof were 700 G in magnetic force. The second developing roller 14 was of the same construction as the first roller 13 except that the main pole 14*b* of the second magnet roller 14*c* had a magnetic force of 1000 G. The bucket roller 15 was 50 mm in diameter and was rotatable at 50 r.p.m.

The magnetic developer De used was of the two-component type comprising a positively chargeable black magnetic toner and a negatively chargeable red nonmagnetic toner. The magnetic toner was prepared from:

| | |
|---|---|
| styrene-acrylic polymer (HYMER-SBM73, product of Sanyo Kasei Co., Ltd.) | 100 parts by weight |
| fine magnetic powder (MAGNETITE RB-BL, product of Titanium Industries, Ltd.) | 100 parts by weight |
| carbon black (MA #100, product of Mitsubishi Chemical Industries, Ltd.) | 4 parts by weight |

by mixing together these materials in a molten state, pulverizing the mixture after cooling and screening the particles. The magnetic toner was 16 μm in mean particle size and $10^{14}$ ohm-cm in resistivity. The nonmagnetic toner was prepared from:

| | |
|---|---|
| polyester resin (non-linear saturated polyester) | 100 parts by weight |
| number average molecular weight: | 12,000 |
| weight average molecular weight: | 220,000 |
| glass transition temperature: | 62° C. |
| red pigment (CHROMOPHTAL RED A38, product of CHIBA Ltd.) | 5 parts by weight |

The nonmagnetic toner was 11 μm in mean particle size and $10^{15}$ ohm-cm in resistivity. The magnetic toner and the nonmagnetic toner were mixed together in a ratio of 85:15.

Figure 8:
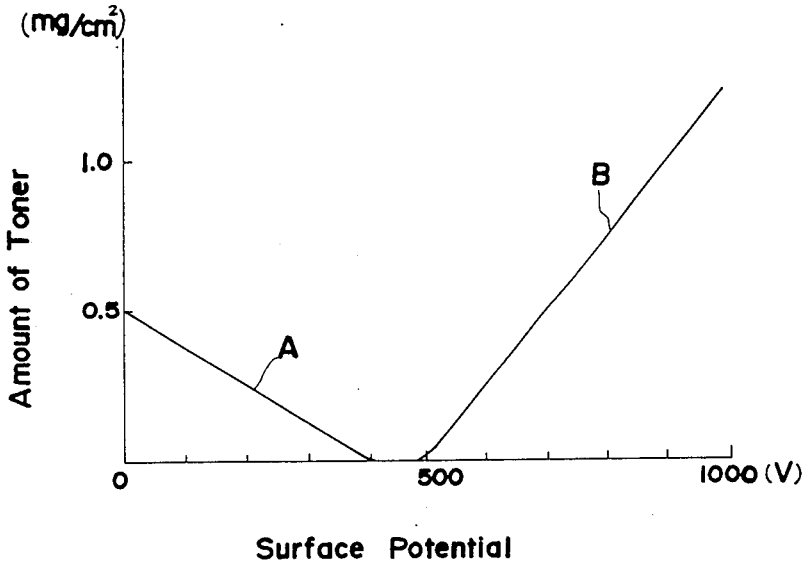
FIG. 8 is a graph showing amounts of deposition of a magnetic toner and a nonmagnetic toner.

Under the conditions described above, the composite electrostatic latent image was developed only by the first developing roller 13 with application of developing bias voltage VB1 of +500 V by the voltage source 13*d*. FIG. 8 shows the developing characteristics obtained. In FIG. 8, the amount of deposition of toner is plotted on the ordinate vs. the potential on the photosensitive drum on the abscissa. Lines A and B represent the magnetic toner and the nonmagnetic toner, respectively. The diagram shows that the nonmagnetic toner adheres to an area having a potential not lower than the bias voltage VB1 of 500 V and that the magnetic toner adheres to an area of potential lower than about 400 V. This indicates that the deposition threshold voltage of the nonmagnetic toner is substantially 0 V relative to the developing bias voltage and that the deposition threshold voltage of the magnetic toner is about 100 V. Furthermore the inclinations of the lines A and B show that the nonmagnetic toner is more prone to deposition.

Next, the composite latent image was developed by the first and second developing rollers 13 and 14 using the above developer. The developing bias voltage VB1 was set to +500 V, and VB2 to +400 V. The dichromatic image developed was sharp and free from color mixture. The first and second latent image areas were developed to a substantially uniform density. Stated more specifically, the composite image as developed by the first developing roller 13 was in the state shown in FIG. 5*b*. The negative nonmagnetic toner was deposited on the first latent image between the bias voltage VB1 of 500 V and Vs of 600. The positive magnetic toner was deposited on the second latent image of 100 V (VLL), while the intermediate potential VL was 350 V. The magnetic toner was approximately uniformly deposited on the area of intermediate potential VL owing to the fact that the potential difference between VB1 and VL was greater than the threshold voltage of the magnetic toner. The frame-like deposition of the nonmagnetic toner due to an edge effect was not found because the bias voltage VB1 was set to a value exceeding the electric field intensity of the edge portion of the second latent image as already stated. Furthermore the deposition of the magnetic toner on the background area also serves to prevent deposition of the nonmagnetic toner on the edge portion.

Subsequently the composite image was developed by the second developing roller 14 to the state shown in FIG. 5*c*. With the bias voltage VB2 set to a level lower than that for the first roller 13, the amount of deposition of the nonmagnetic toner on the first latent image increased, and the amount of deposition of the magnetic toner on the second latent image also increased slightly. On the other hand, the magnetic toner deposited on the background area of intermediate potential VL was completely collected by the second developing roller 14 partly because the main pole 14*b* of the second magnet roller 14*c* had a great magnetic force. In fact, the transferred copy image obtained was free from fog.

EXPERIMENTAL EXAMPLE 2

A composite electrostatic latent image was formed and developed under the same conditions as in Experimental Example 1 with the exception of using the developer described below. A satisfactory copy image was obtained as in Experimental Example 1.

The developer was a three-component magnetic developer comprising 67 wt. % of a magnetic carrier, 13 wt. % of a nonmagnetic toner and 20 wt. % of a magnetic toner in mixture. The magnetic carrier was prepared from:

| | |
|---|---|
| styrene-acrylic polymer (HYMER-SBM73, product of Sanyo Kasei Co., Ltd.) | 100 parts by weight |
| fine magnetic powder (MAGNETITE RB-BL, product of Titanium Industries, Ltd.) | 100 parts by weight |
| carbon black (MA #100, product of Mitsubishi Chemical Industries, Ltd.) | 4 parts by weight |

by mixing together these materials in a molten state, pulverizing the mixture after cooling and screening the particles. The carrier was 35 μm in mean particle size and $10^{13}$ ohm-cm in resistivity. The nonmagnetic toner was prepared from:

| | |
|---|---|
| styrene-acrylic polymer (PLIORITE AC, product of Goodyear Industries Corp.) | 100 parts by weight |
| carbon black (MA #100) | 8 parts by weight |
| charge control dye (NYGROSINE, product of Orient Chemical Industries, Ltd.) | 2 parts by weight |

in the same manner as above. The toner was 12 μm in mean particle size and $10^{15}$ ohm-cm in resistivity. The magnetic toner was prepared from:

| | |
|---|---|
| styrene-acrylic polymer (HYMER-SBM73) | 150 parts by weight |
| fine magnetic powder (MAGNETITE RB BL) | 100 parts by weight |
| carbon black (MA #100) | 6 parts by weight |

in the same manner as above. The magnetic toner was 11 μm in mean particle size and $10^{14}$ ohm-cm in resistivity. Both the magnetic toner and the nonmagnetic toner were black. The developer was thoroughly agitated. As a result, the nonmagnetic toner was triboelectrically charged to positive polarity by contact with the magnetic carrier, while the magnetic toner was triboelectrically charged to negative polarity by contact with the magnetic toner.

The copy image obtained was sharp, free from fog and satisfactory in density. When the composite image was checked immediately after the development by the first developing roller 13, the magnetic toner was found to have been deposited on the area of intermediate potential VL.

EXPERIMENTAL EXAMPLE 3

An image forming experiment was conducted under the same conditions as in Experimental Example 1 with the exception of using the developing unit shown in FIG. 4. With reference to FIG. 4, the first and second developing rollers 17 and 22 were spaced from the photosensitive drum 1 by gaps of 0.8 mm and 0.4 mm, respectively. The sleeve 17*a* of the first developing roller 17 was rotatable clockwise at 60 r.p.m., and the first magnet roller 17*b* counterclockwise at 1200 r.p.m. The sleeve 22*a* of the second developing roller 22 was stationary, while the second magnet roller 22*b* was rotatable clockwise at 1600 r.p.m. as induced by the rotation of the first magnet roller 17*b*. The developer was supplied to the first roller 17 only but not supplied to the second roller 22. The developing bias voltages VB1 and VB2 were set to 500 V and 350 V, respectively.

The copy image obtained was sharp and free from fog or other faults. The composite latent image as developed by the first roller 17 was in the state of FIG. 5*b* as in the case of Experimental Example 1. When subsequently developed by the second roller 22, the image exhibited substantially no change, but the magnetic toner deposited on the intermediate potential area was removed by collection. With no developer supplied to the second roller 22, the toner image as developed by the first roller 17 was not further developed by the second roller 22. However, since the gap between the second developing roller and the drum was much smaller, the roller 22 had a greater magnetic force, completely removing the magnetic toner from the intermediate potential area and giving a copy image as shown in FIG. 5*d*.

As will be apparent from the foregoing description, the image forming method of the present invention affords fog-free satisfactory copy images without permitting deposition of toner on the edge portion of the first or second electrostatic latent image due to an edge effect. Moreover, the method is simple in respect of control and the construction of the apparatus therefor because the method can be practiced merely by setting to a specified value the bias voltage to be applied to the developing electrode and adding magnetic toner collecting means to a usual magnetic brush developing unit. The copy images produced have a high density, while dichromatic copy images can be obtained easily when required. Thus, the present method has various outstanding advantages.

What is claimed is:

1. An image forming method comprising:

a first step of forming on a photosensitive member electrostatic latent images having at least three, different potential levels and including a first electrostatic latent image represented by a first potential relative to a background area potential and a second electrostatic latent image represented by a second potential relative to the background area potential;

a second step of developing said first and second electrostatic latent images by first magnetic brush developing means using two kinds of toners at least one of which is magnetic and which are chargeable to polarities opposite to each other while applying to a developing electrode a bias voltage capable of depositing the magnetic toner on the background potential area thereby selectively depositing the two toners on the first and second latent images and the magnetic toner on the background potential area, and further collecting the deposited magnetic toner from the background potential by second magnetic brush developing means; and a third step of transferring the developed images onto a paper.

2. An image forming method as claimed in claim 1 wherein said bias voltage applied to the developing electrode of said first magnetic brush developing means is so set to exceed at least the electric field intensity of edge portions of said second electrostatic latent image.

3. An image forming method as claimed in claim 2 wherein the first, second and background area potentials are all of the same polarity.

4. An image forming method as claimed in claim 2 wherein the first and second potentials are opposite in polarity.

5. An image forming method as claimed in claim 2 wherein said second magnetic brush developing means includes a developing electrode to which a bias voltage is applied and said bias voltage is so set that the difference between said bias voltage and the background area potential is smaller than the deposition threshold voltage of the magnetic toner.

6. An image forming method comprising;

a first step of forming on a photosensitive member electrostatic latent images having at least three different potential levels and including a first latent image represented by a first potential $V_s$ relative to background area potential $V_L$ and a second latent image represented by a second potential $V_{LL}$ relative to said background area potential $V_L$, said first, second and background area potentials are of all same polarity;

a second step of developing said first and second latent images by first magnetic brush developing means using a developer including magnetic and non-magnetic toners chargeable to polarities opposite to each other while applying to a developing electrode a bias voltage $V_{B1}$ capable of depositing the magnetic toner on the background area potential $V_L$ thereby selectively depositing the two toners on the first and second latent images and the magnetic toner further on the background area potential, said bias voltage $V_{B1}$ being so set relative to said background area potential $V_L$ that it is free of influence of electric field intensity of edge portions of either of said first or second latent image and it exceeds the deposition threshold voltage of the magnetic toner, said second step further including a step to collect the deposited magnetic toner on the background area potential; and a third step of transferring the developed image.

7. An image forming method comprising:

a first step of forming on a photosensitive member electrostatic latent images having at least three different potential levels and including a first latent image represented by a first potential relative to a background area potential and a second latent image represented by a second potential relative to said background area potential, said first and second potentials being opposite in polarity;

a second step of developing said first and second latent images by first magnetic brush developing means using a developer including magnetic and non-magnetic toners chargeable to polarities opposite to each other while applying to a developing electrode a bias voltage capable of depositing the magnetic toner on the background area potential thereby selectively depositing the two toners on the first and second latent images and the magnetic toner further on the background area potential, said bias voltage being so set relative to said background area potential that it is free of influence of electric field intensity of edge portions of either of said first or second latent image and it exceeds the deposition threshold voltage of the magnetic toner, said second step further including a step to collect the deposited magnetic toner on the background area potential; and a third step of transferring the developed image.

* * * * *